US005482277A

United States Patent [19]

Young

[11] Patent Number: 5,482,277

[45] Date of Patent: Jan. 9, 1996

[54] METHOD OF OPERATING A TALKING CRYSTAL BALL TOY

[76] Inventor: Gordon Young, 1270 Champion Cir., Carrollton, Tex. 75006

[21] Appl. No.: 263,826

[22] Filed: Jun. 22, 1994

[51] Int. Cl.[6] ..... A63F 9/18

[52] U.S. Cl. ..... 273/161; 446/397; 446/485

[58] Field of Search ..... 446/379, 81, 175, 446/297–303, 404, 408, 484, 485, 397; 273/455, 460, 138 A, 161

[56] References Cited

U.S. PATENT DOCUMENTS

| | | | |
|---|---|---|---|
| 3,798,833 | 3/1974 | Campbell | 273/161 |
| 3,851,875 | 12/1974 | Buslow et al. | 273/455 |
| 4,054,286 | 10/1977 | Dussler, Sr. | 446/485 |
| 4,237,647 | 12/1980 | Shaw . | |
| 4,282,681 | 8/1981 | McCarlin | 446/397 |
| 4,314,423 | 2/1982 | Lipritz et al. | 446/175 |
| 4,765,623 | 8/1988 | Cardillo et al. | 273/161 |
| 5,021,768 | 6/1991 | Kishida et al. | 273/460 |
| 5,089,745 | 2/1992 | Sannini | 446/485 |
| 5,228,879 | 7/1993 | Fromm | 446/219 |

FOREIGN PATENT DOCUMENTS

| | | | |
|---|---|---|---|
| 2185898 | 10/1986 | United Kingdom | 446/175 |

*Primary Examiner*—Robert A. Hafer
*Assistant Examiner*—Michael O'Neill

[57] ABSTRACT

A Talking Crystal Ball Toy operatively electrically effective to respond to a previously asked question in which the battery-operated circuit providing this operating mode is completed through the body of the user which significantly enhances the play value of the toy.

1 Claim, 2 Drawing Sheets

METHOD OF OPERATING A TALKING CRYSTAL BALL TOY

The present invention generally relates to a sound-emitting toy in the specific form of a display simulating a fortune teller's crystal ball having an operating mode in which a question asked by the user is responded to by the toy, the response being, of course, the sound emission function embodied in the toy.

EXAMPLES OF THE PRIOR ART

Toys having an audio output as their play value are already well known. The audio output in some such known toys is, in fact, in the specific form of simulated speech or digitized voice tracks as exemplified by U.S. Pat. No. 5,228,879 for "Toy Mirror Assembly" issued to Wayne G. Fromm on Jul. 20, 1993.

Simulated speech is also known to be used in a toy display consisting of a fortune teller's crystal ball as described and illustrated in U.S. Pat. No. 4,765,623 for "Talking Crystal Ball Toy" issued to Gary J. Cardillo et al. on Aug. 23, 1988, of which the within "crystal ball" toy is an improvement having significantly enhanced play value.

Broadly, it is an object to provide a talking crystal ball toy overcoming the nominal play value shortcoming of the prior art.

More particularly, it is an object to embody a talking crystal ball toy with operating parameters better understood, and consequently better enjoyed, by the children using the toy, all as will be subsequently explained in detail.

The description of the invention which follows, together with the accompanying drawings should not be construed as limiting the invention to the example shown and described, because those skilled in the art to which this invention appertains will be able to devise other forms thereof within the ambit of the appended claims.

In U.S. Pat. No. 4,765,623 entitled "Talking Crystal Ball Toy" issued to Cardillo et al. on Aug. 23, 1988 which, by this reference, is incorporated herein in its entirety, the play value is a "double pass of the operator's hands over [the crystal ball]to give a randomly selected verbal response to a question asked by the operator". As a departure from this prior art which significantly enhances the already considerable play value of this known audio-emitting toy, the within inventive improvement contemplates use of a circuit for the audio emission (and also illumination) which is completed through the body of the user, thus replacing the referred to "double pass" arm movements with a more direct toy-contacting requirement that in practice has been found to be better understood as an operating parameter, and consequently better enjoyed, by the children using the toy.

Figure 1:
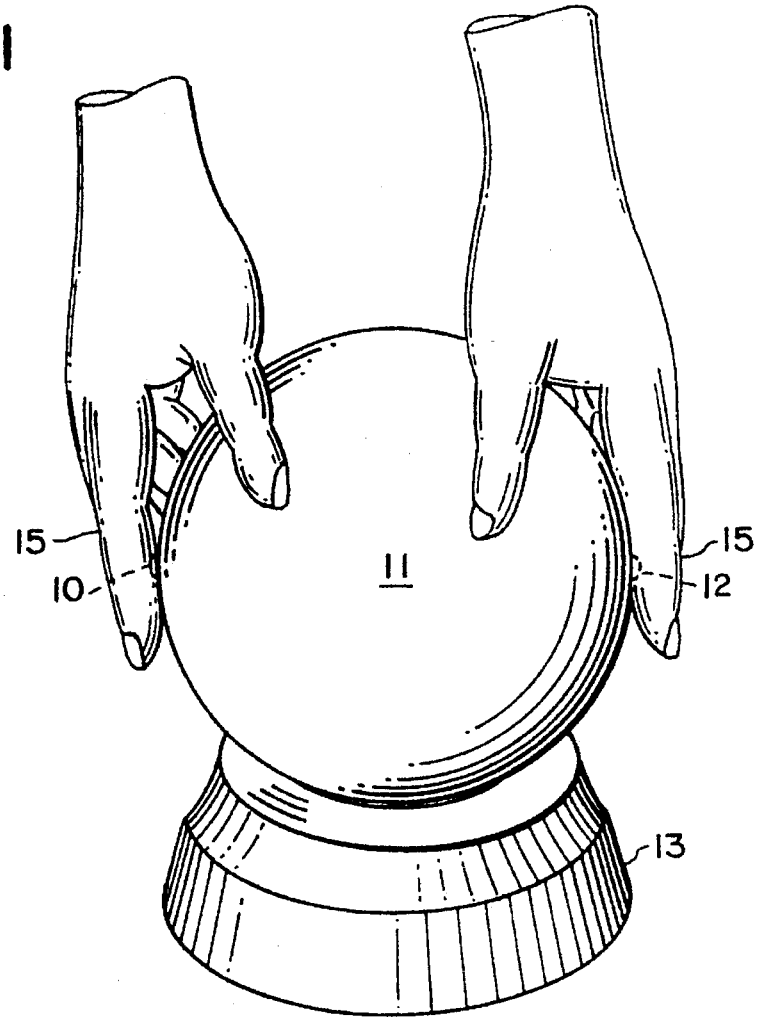
FIG. 1 is a perspective view of the within inventive child's action toy in the specific form simulating a fortune teller's crystal ball illustrating the hand position of the user which causes illumination thereof.
Figure 3:
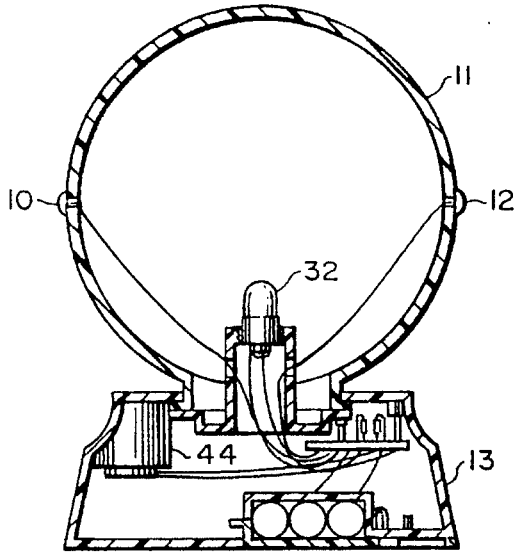
FIG. 3 is, like FIG. 2, another front elevational view with a portion of the simulated crystal ball broken away to illustrate further structural details.
Figure 4:
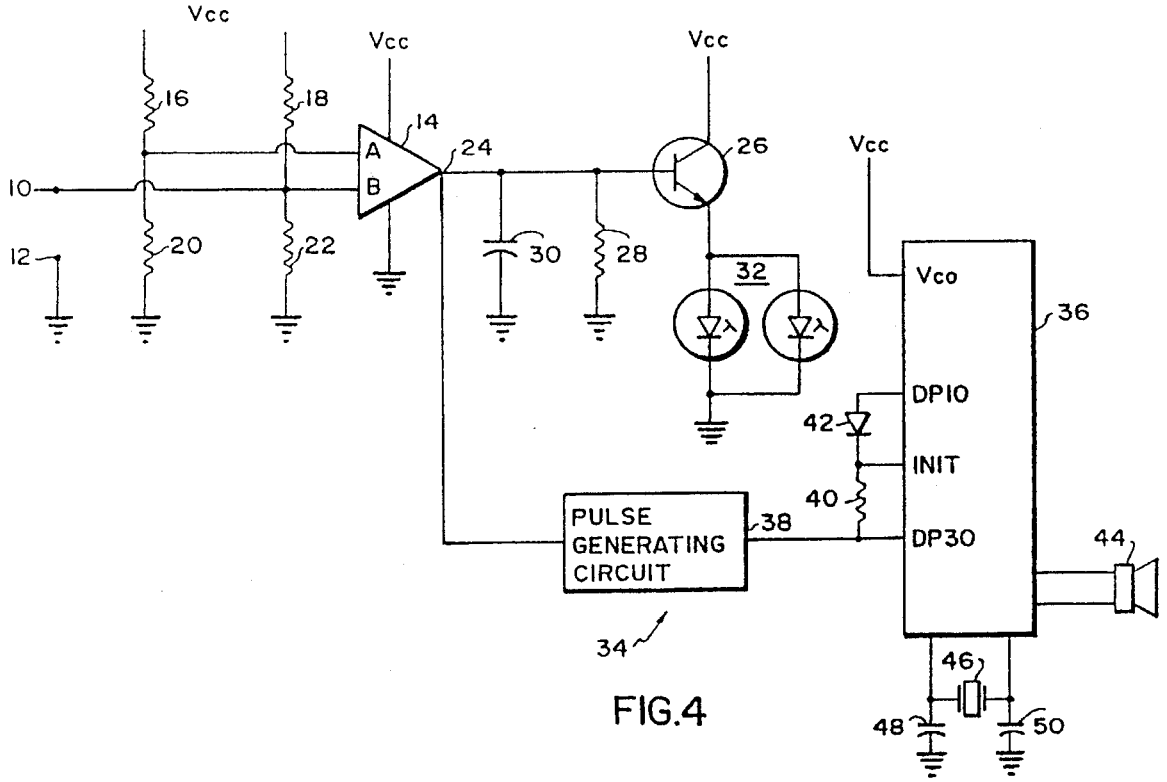
FIG. 4 is a circuit diagram of the electrical components for the toy operating mode contemplating said illumination of FIG. 1 and said audio response of FIG. 2.

As shown in FIG. 1, the within fortune teller's simulated crystal ball is presented in a well known display consisting of a frosted glass sphere 11 appropriated mounted in a plastic base 13. On opposite side of sphere or ball 11 and hidden in FIG. 1 under the user's fingers 15, but readily discernible in FIGS. 2 and 3, are external circuit contacts 10 and 12 respectively electrically connected to electrical components illustrated, and soon to be described in detail, in the circuit diagram of FIG. 4, said electrical components being in an operative stored condition in an appropriate manner in an internal compartment 21 bounded by the ball 11 and base 13.

The operating mode-enhancement to the toy's play value contemplates, as illustrated in FIG. 1, the user first completing a circuit through his/her body resulting from contact of fingers 15 over the contacts 10 and 12. The circuit of FIG. 4 thusly completed, energizes a battery-operated bulb illuminating the ball 11, and functionally readying audio emitting means of said FIG. 4 circuit for an audio response to a previous question addressed to the illuminated ball 11 by the user which, in a well understood manner, will be a response randomly selected in the present embodiment of this invention from one of the below possible responses:

NO WAY
YES, NO DOUBT
COULD BE
NOT LIKELY
NO CHANCE
OF COURSE YOU CAN
WHAT DO YOU THINK?
WHATEVER
YOU BET
FOR SURE

Figure 2:
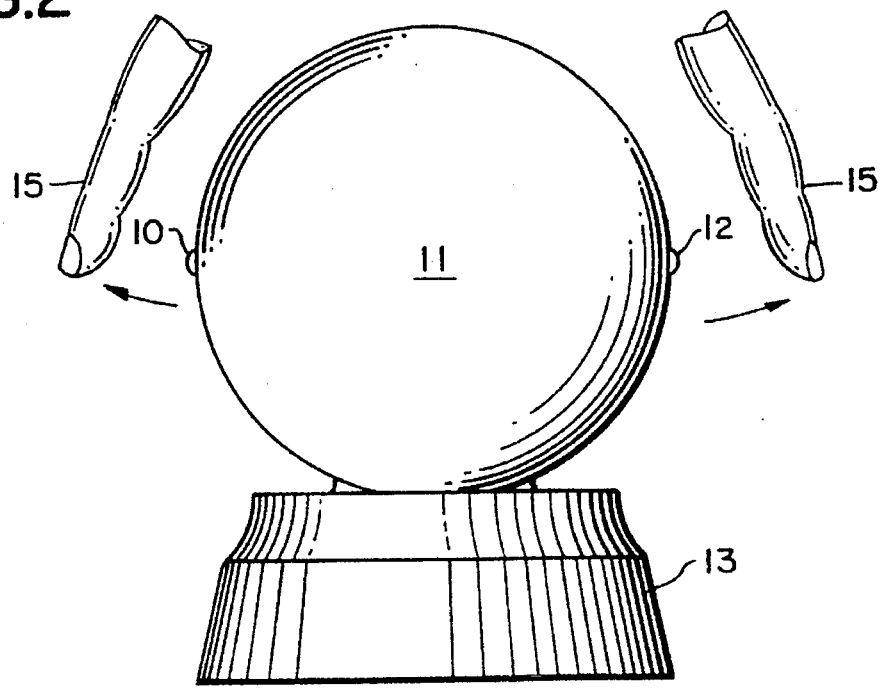
FIG. 2 is a front elevational view of said toy illustrating another hand position of the user which causes an audio response to a previously asked question.

The operating parameter resulting in the audio response is the opening of the closed circuit occasioned by removal of finger contact 15 with the contacts 10, 12, as depicted in FIG. 2. Although the circuitry providing the operating mode of the toy 11, 13 which distinguishes over the prior art toy of U.S. Pat. No. 4,765,623 and all other known question-responding toys is well known and understood by those skilled in the art to which this invention appertains, for completeness' sake a description of said FIG. 4 circuit, in electrical art parlance, now follows.

The circuitry of the present invention monitors the user's touch with the exposed metallic contact sensors, and upon sensing such contact, energizes the lights for so long as contact is maintained. When contact is released, the lights are extinguished, and the voice playback is activated. After a prerecorded phrase is played, the system resets itself for a subsequent contact.

As depicted in FIG. 1, contact 10 is part of the input network for operational amplifier 14, while contact 12 is tied to ground. Operational amplifier 14 is configured as a comparator, whereby its output on line 24 is high when the voltage at its positive input A is greater than the voltage at its negative input B. If the voltages are equal, or if the voltage at the negative input is greater that than the positive input, the output is low.

Resistors 16, 20 form a voltage divider between $V_{cc}$ and ground for input A, while resistors 18, 22 form a similar voltage divider for input B. As well known, the voltage at the input $V_i = R_1 + R_2/R_1R_2$ where $R_1$ is the resistance between the input and $V_{cc'\ and\ R2}$ is the resistance between the input and ground. The values are chosen such that the voltage at B is slightly higher than at A, thus forcing the output of the amplifier to be low. Typically, the values for the resistors are in megohms, to insure minimal current flow. When the user contacts the sensors 10, 12, body resistance is placed in parallel with resistor 22, reducing the effective resistance between input B and ground, and thus lowering the voltage at the input. With the amplifier now sensing a greater voltage at input A the comparator turns "on", driving the output 24 high for so long as the body contact is maintained.

The output 24 of the amplifier is fed to the base of transistor 26. With a positive voltage applied to its base, the collector-emitter path of the transistor is enabled, allowing current to flow through the illumination elements 32. As shown in the Figure, the elements 32 may be light-emitting diodes, but other light sources, such as hot filament bulbs, may be used. Alternatively, the transistor 26 may drive a relay, allowing multiple light sources or other transducers to be driven as may be desired. Resistor 28 and parallel capacitor 30 may be placed between output 24 and ground to damp any transients in the amplifier output. When touch contact is released, the transistor 26 shuts off, extinguishing the illumination elements.

When contact with the sensors is released, the voice cycle must be activated. The output of amplifier 24 is thus also coupled to the input of pulse generating circuit 34, which serves as the activating element for speech generator integrated circuit 36. Speech generator circuit 36, which may be a Texas Instruments TSP50C41, is programmed in a manner known in the art to select and synthesize one of a plurality of phrases stored in its integral memory. Speech output is initiated by the application of a pair of low pulses to its control terminals within a span of approximately 3 seconds. Pulse generating circuit 34 is configured to provide such pulses on its output line 38.

The steady state output of pulse generating circuit 34 on line 38 is high. This output is connected to the DP 30 terminal of speech circuit 36 and thus places it high, along with the INIT terminal, coupled to the DP30 terminal through resistor 40. Terminal DP 10 is maintained low because of diode 42. When pulse generating circuit 34 is activated by the return of the output 24 of amplifier 14 to the low state upon release of user contact with the contacts 10, 12, its output line 38 drops low a first time, driving the DP 30 and INIT terminals low, placing the DP terminal high. Within three seconds, the second low output on line 38 is generated, again driving the DP 30 terminal low, causing speech generation to occur. The speech is broadcast through speaker 44.

Pulse generating circuit 34 may produce the low pulse outputs in any of a variety of manners as known in the art. For example, it may comprise a pair of multivibrators connected in parallel. Each multivibrator may be configured as a one-shot pulse generator, to provide a short duration low-output triggered by the transition of amplifier output line 24 from high to low. One of the multivibrators may be further configured to provide a short delay, about 1.5 seconds, before generating its output, providing the sequential pulses required by the speech generator. The outputs of the multivibrators are fed through an "or" gate to the output line 38.

During the speech generation process, the DP10 terminal remains high, and additional pulse generating circuit pulse outputs during this period will have no effect on its operation. After generation is completed, a subsequent pair of pulses will start a new speech generation cycle. As known in the art, the speed of generator 36 is controlled by an external oscillator, comprised of crystal 46 and capacitors 48, 50. The oscillator controls the tonal quality of the synthesized speech. Typical values for the crystal is 3.07MHz, and for the capacitors, 33pf. Power $V_{cc}$ for the system may be supplied by batteries, coupled to provide between 4.5 and 6 volts. Values for other circuit components depicted in the Figure may be easily determined by those skilled in the art.

While the action toy for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of operating a child's fortune telling toy comprising the steps of supporting a glass sphere on a base to simulated a known fortune teller's display, embodying said fortune teller's display with an electrical circuit having an operating mode of alternately illuminating said glass sphere and emitting a simulated voice message, establishing two open electrical contacts for said electrical circuit each on an opposite side of said glass sphere adapted when contacted and released by a user of the toy to provide said operating mode of said electrical circuit, contacting simultaneously said two electrical contacts so as to electrically complete said electrical circuit to illuminate said glass sphere and to provide a dwell interval in the operation of said toy during which a question is posed for response to said toy, and releasing said electrical contacts to allow the completion of said electrical circuit operating mode so as to provide the emitting of a simulated voice message, whereby said voice message is perceived as the response to the posed question to contribute to the play value of said toy.

* * * * *